US008408235B2

(12) United States Patent
Wu

(10) Patent No.: US 8,408,235 B2
(45) Date of Patent: Apr. 2, 2013

(54) HEAD FOR AIR PUMP

(76) Inventor: Scott Wu, Taichung Hsien (TW)

( * ) Notice: Subject to any disclaimer, the term of this patent is extended or adjusted under 35 U.S.C. 154(b) by 332 days.

(21) Appl. No.: 12/912,930

(22) Filed: Oct. 27, 2010

(65) Prior Publication Data

US 2012/0031504 A1 Feb. 9, 2012

(30) Foreign Application Priority Data

Aug. 3, 2010 (TW) ..... 99125786 A

(51) Int. Cl.
*F16K 15/20* (2006.01)

(52) U.S. Cl. ..... 137/231; 137/223; 417/469; 417/487

(58) Field of Classification Search ..... 137/231, 137/223; 251/149.8, 149.9, 251; 417/234, 417/379, 469, 467, 487, 521, 569
See application file for complete search history.

(56) References Cited

U.S. PATENT DOCUMENTS

| | | | | | |
|---|---|---|---|---|---|
| 5,762,095 | A | | 6/1998 | Gapinski et al. | 137/223 |
| 5,819,781 | A | * | 10/1998 | Wu | 137/231 |
| 5,960,815 | A | * | 10/1999 | Wang | 137/231 |
| 5,975,109 | A | * | 11/1999 | Wu | 137/231 |
| 5,983,920 | A | * | 11/1999 | Gapinski et al. | 137/231 |
| 6,073,645 | A | * | 6/2000 | Wu | 137/231 |
| 6,076,544 | A | * | 6/2000 | Pierce | 137/231 |
| 6,102,063 | A | * | 8/2000 | Pierce et al. | 137/231 |
| 6,105,600 | A | * | 8/2000 | Wang | 137/231 |
| 6,105,601 | A | * | 8/2000 | Wang | 137/231 |
| 6,135,733 | A | | 10/2000 | Wu | 417/467 |
| 6,146,116 | A | * | 11/2000 | Wu et al. | 137/231 |
| 6,164,938 | A | * | 12/2000 | Chuang | 417/234 |
| 6,220,273 | B1 | * | 4/2001 | Wu | 137/231 |
| 6,220,274 | B1 | * | 4/2001 | Wang | 137/231 |
| 6,276,405 | B1 | * | 8/2001 | Wang | 152/415 |
| 6,289,920 | B1 | * | 9/2001 | Wang | 137/231 |
| 6,328,057 | B1 | * | 12/2001 | Wang | 137/231 |
| 6,378,547 | B1 | * | 4/2002 | van der Blom | 137/223 |
| 6,401,744 | B1 | * | 6/2002 | Van Der Blom | 137/231 |
| 6,631,729 | B2 | * | 10/2003 | van der Blom | 137/231 |
| 6,786,247 | B1 | * | 9/2004 | Kemppainen et al. | 137/231 |
| 6,843,270 | B1 | * | 1/2005 | Wang | 137/231 |
| 6,893,232 | B2 | * | 5/2005 | Wu | 417/547 |
| 6,953,326 | B2 | * | 10/2005 | Wang | 417/234 |
| 6,955,531 | B2 | * | 10/2005 | Wu | 137/231 |
| 7,032,613 | B2 | * | 4/2006 | Delorme | 137/231 |
| 7,040,355 | B2 | * | 5/2006 | Wu | 137/223 |
| 7,093,609 | B2 | * | 8/2006 | Chen | 137/231 |
| 7,178,549 | B2 | * | 2/2007 | Wu et al. | 137/223 |
| 7,562,671 | B2 | * | 7/2009 | Wang | 137/231 |
| 7,658,596 | B2 | * | 2/2010 | Wu | 417/234 |
| 7,762,797 | B2 | * | 7/2010 | Wu | 417/572 |

(Continued)

*Primary Examiner* — Craig Schneider
*Assistant Examiner* — Craig J Price
(74) *Attorney, Agent, or Firm* — Alan Kamrath; Kamrath IP Lawfirm, P.A.

(57) ABSTRACT

A head for an air pump includes a housing, a nozzle, an urging mechanism, and an end cap. The housing includes a first compartment defined therein and including a first end defining an opening port and a second end enclosed by an end wall. The housing further includes a hole extending therethrough and into the first compartment. The nozzle device is disposed within the first compartment. The urging mechanism includes a cam, an axle and a pivoting member. The cam is disposed in the first compartment and abuts against the nozzle device. The axle is inserted into the housing through the holes and engages with the cam. The pivoting member is connected to the cam by engaging with a terminal end of the axle.

14 Claims, 11 Drawing Sheets

U.S. PATENT DOCUMENTS

| | | | | |
|---|---|---|---|---|
| 7,862,065 | B2 * | 1/2011 | Hawkins et al. | 417/234 |
| 7,866,335 | B2 * | 1/2011 | Wang | 137/231 |
| 8,156,955 | B2 * | 4/2012 | Wang | 137/231 |
| 8,297,953 | B2 * | 10/2012 | Wu | 417/234 |
| 2005/0145276 | A1 * | 7/2005 | Wu et al. | 137/223 |
| 2007/0148023 | A1 | 6/2007 | Wu | 417/556 |
| 2008/0308158 | A1 | 12/2008 | Wu | 137/231 |

* cited by examiner

HEAD FOR AIR PUMP

BACKGROUND OF THE INVENTION

1. Field of the Invention

The present invention relates to a head for an air pump.

2. Description of the Related Art

A floor pump is an air pump that is commonly known. While the floor pump has the advantage of enabling the user to pump an item to be inflated in an efficient way, it needs a large storage space, and carrying it is not easy. Therefore, it is not convenient for the user to carry a floor pump with him. Then, a portable air pump is invented, and it finds favor with bicycle riders. Generally, a portable air pump includes a hose exposed outside the body of the portable pump and a footstand which is retractable. Then, a mini pump is invented. Generally, a mini pump has no hose attached to and exposed outside the body of the mini pump in order to achieve a compact volume. Moreover, a mini pump generally has a flush overall outlook. Therefore, a mini pump has the advantage of having an appealing appearance, and it is convenient for the user to carry the mini pump with him.

As set forth, air pumps are classified into three categories: a floor pump, a mini pump and a frame floor pump. The floor pump generally has a large cylinder for allowing a large volume of air to be pumped out per stroke. Furthermore, the floor pump has a pedal and a handle, and the user can step on the pedal and hold the handle during the operation of the floor pump. The mini pump has a smaller volume relative to the floor pump so that it is convenient and easy for the user to carry the mini pump. When operating the mini pump, the user grips a cylinder of the mini pump in one hand and grips a nozzle head of the mini pump in another hand. However, it is laborious to operate the mini pump, because it does not provide a fulcrum during the operation thereof. The frame floor pump combines the advantages of the floor pump and the mini pump. It has a footstand and a handle which can be pivoted from a position aligned with a cylinder of the frame floor pump to a position perpendicular to the cylinder during the operation of the frame floor pump, and user can step on the pedal and grip on the handle to achieve an effort-saving operation. Additionally, it has a small volume so that it can be carried easily.

U.S. Pat. No. 6,135,733 shows a portable air pump. The pump includes a head, and the head includes a compartment defined therein. The compartment includes an air outlet port defined at a side thereof, and includes a nozzle and a plug disposed therein. The nozzle and the plug are retained in the compartment by an end cap mounted in the air outlet port. It is appreciated that the head is of an enclosed configuration so the nozzle and the plug enclosed in the head are prevented and protecated from dust particles, thereby their use life will not be shortened quickly. While the plug is adapted to push the nozzle to engage with the head to create an air-tight condition between the nozzle and the head, the plug can not automatically engage with the nozzle securely. It is, however, required that the user continually push the head to achieve an air-tight condition with the nozzle while carrying out an inflating operation.

U.S. Patent Publication No. 2007/0148023 shows an air pump including a head, a plug slidably disposed in a compartment defined in the head, a pivoting member mounted to a first distal end of the head and abutting against an end of the sliding member, a nozzle disposed on another end of the sliding member opposite to the pivoting member, and an end cap engaged with a second distal end of the head. The compartment extends from the first distal end to the second distal end. The sliding member and the nozzle are prevented from disengagement from the head as the pivoting member restrains them from escaping out of the first distal end thereof, and the end cap restrains them from escaping out of the second distal end thereof, respectively. While the pivoting member is adapted to push the plug and the nozzle sequentially in order to enable the nozzle to automatically engage with the head securely and in an air-tight condition, the head can not protect the plug and the nozzle from contact with dust particles, which would shorten their use life quickly. Another drawback is that this pivoting member protrudes prominently and is not aesthetic pleasing. It is acknowledged that other references, for example, U.S Patent Publication No. 2008/0308158 and U.S. Pat. No. 5,762,095, suffer the same problem as neither of the pump heads can preclude dust particles from damaging parts disposed therein.

The present invention is, therefore, intended to obviate or at least alleviate the problems encountered in the prior art.

SUMMARY OF THE INVENTION

According to the present invention, a head for an air pump includes a housing, a nozzle, an urging mechanism, and an end cap. The housing extends from a first distal end to a second distal end, and includes a first compartment extending therein from a first end defined at the first distal end of the housing to a second end. The second end of the first compartment is enclosed by an end wall. The housing further includes a hole extending therethrough and into the first compartment. The nozzle device is disposed within the first compartment of the housing. The urging mechanism includes a cam, an axle and a pivoting member. The cam is disposed in the first compartment of the housing, and abuts against the nozzle device. The axle is inserted into the housing through the holes and engages with the cam. Furthermore, the axle is rotatable with respect to the housing, and the cam is rotatable with the axle. The pivoting member is connected to the cam by engaging with a terminal end of the axle. Furthermore, the pivoting member is rotatable with the axle. The end cap is engaged with the first distal end of the housing.

It is an object of the present invention to provide a head for an air pump that overcomes the problems as set forth in the description of the related art.

It is another object of the present invention to provide a head for an air pump that has simple structural parts.

It is a further object of the present invention to provide a head for an air pump that has a lower manufacture cost than conventional heads.

It is yet a further object of the present invention to provide a head for an air pump with an aesthetic pleasing and streamlined pivoting member.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
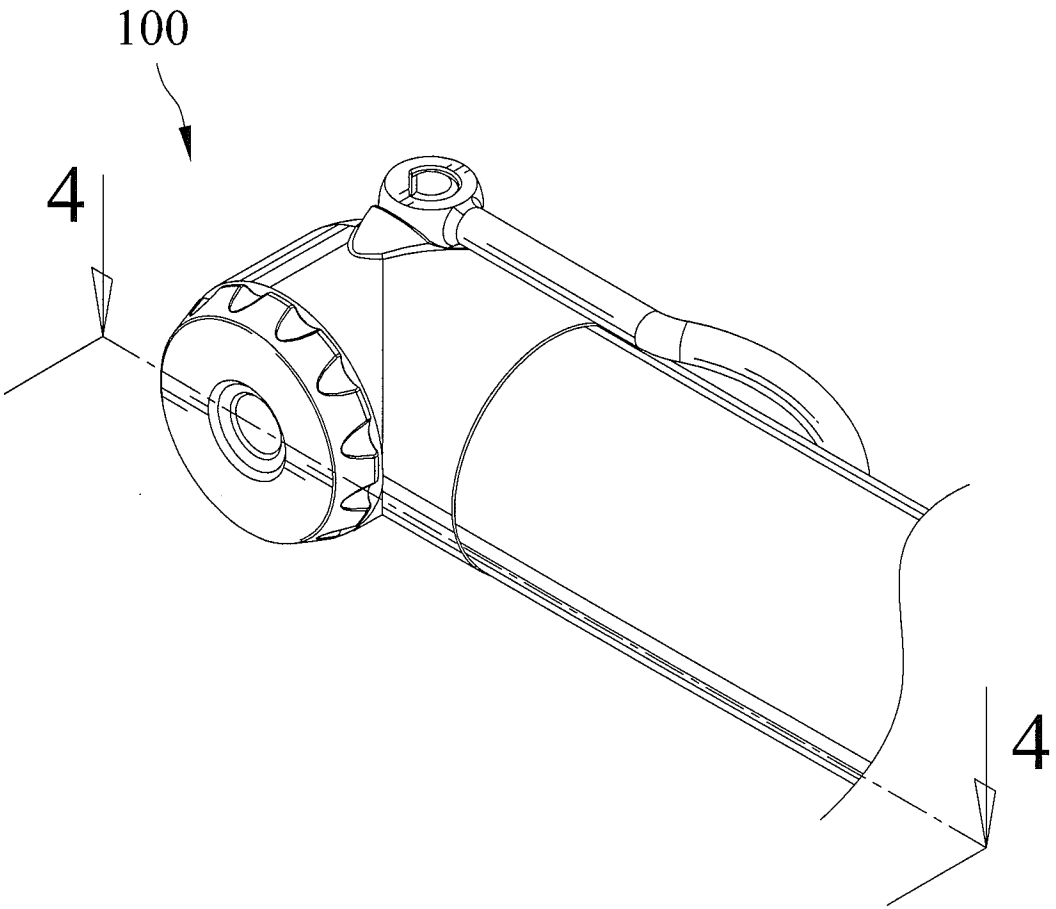
FIG. 1 is a perspective view of a head for an air pump in accordance with a first embodiment of the present invention.
Figure 2:
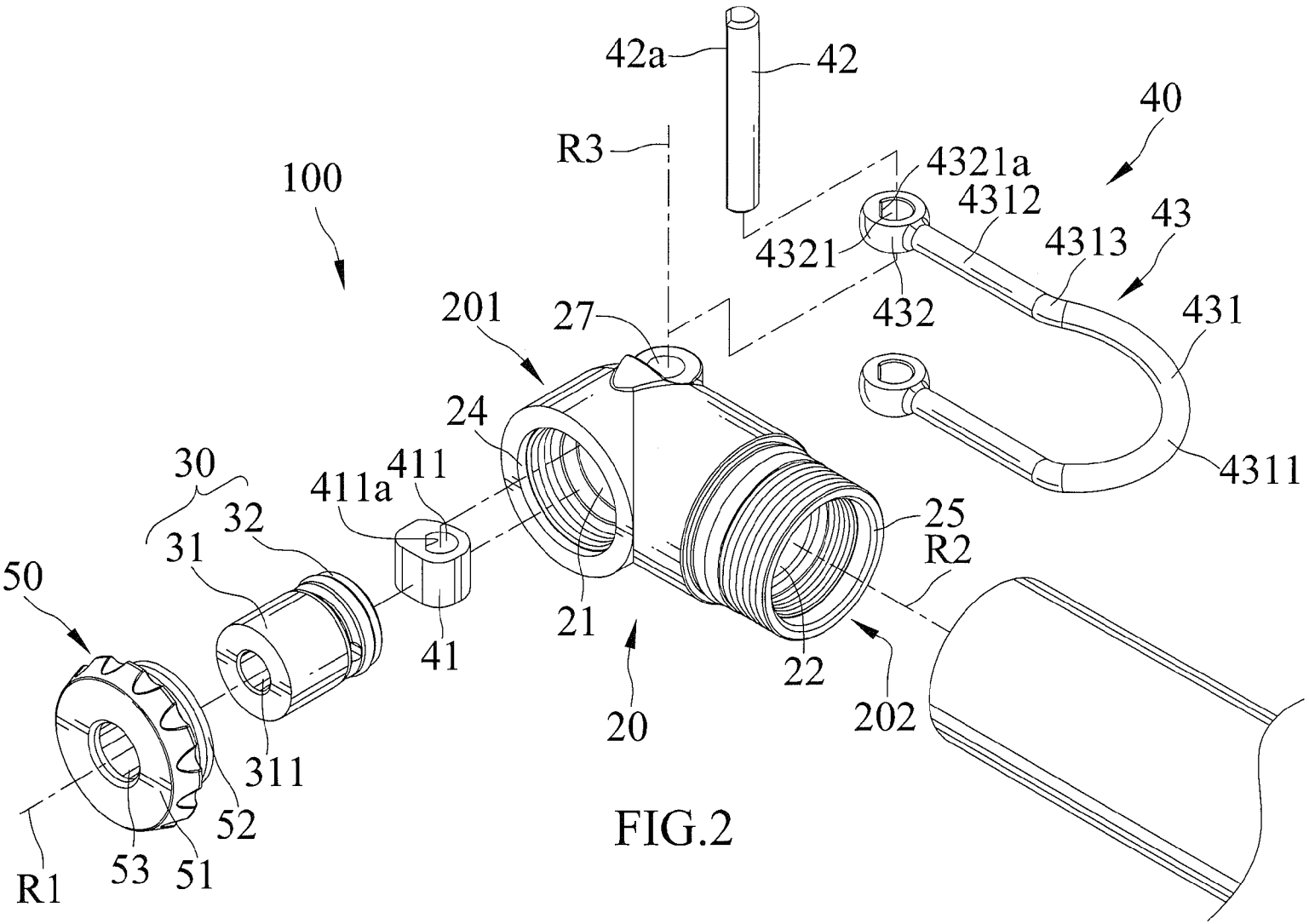
FIG. 2 is an exploded perspective view of the head shown in FIG. 1.
Figure 3:
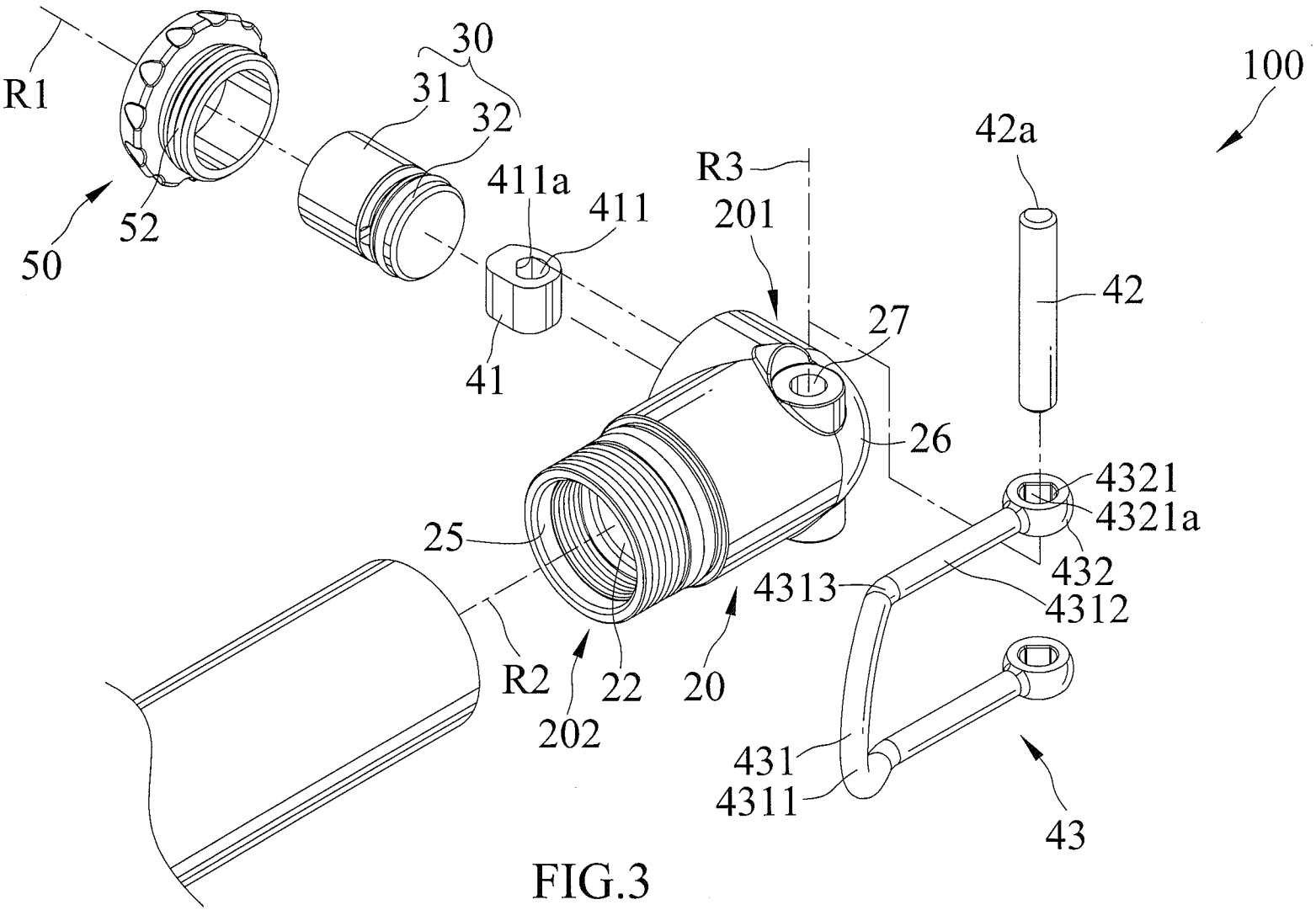
FIG. 3 is another exploded perspective view of the head shown in FIG. 1, taken from a different angle of view than that in FIG. 2.

Referring to the FIGS. 1 through 10, a head 100 for an air pump in accordance with a first embodiment of the present invention defines a housing 20 and includes a nozzle device 30, an urging mechanism 40, and an end cap 50. The housing 20 defines two distal ends, i.e., a first distal end 201 and a second distal end 202, and includes first and second compartments 21 and 22 defined therein. The first compartment 21 extends longitudinally along an axis "R1" from a first end to a second end. The first end is defined at the first distal end 201 of the housing 20 as well as defines an opening port 24, that is, the first end is an open end. In addition, the second end is enclosed by an end wall 26, that is, the second end is a closed end. The second compartment 22 extends longitudinally along an axis "R2" from a first end to a second end and communicates with the first compartment 21 through a passage 23 that defines one of two terminal ends connected to the first compartment and the other of the two terminal ends connected to the first end of the second compartment 22. The first end is an open end connecting to the passage 23. In addition, the second end of the second compartment 22 is defined at the second distal end 202 of the housing 20 as well as defines an opening port 25, that is, the second end is an open end. The axis "R2" is perpendicular to the axis "Rl". The housing 20 further includes two holes 27 extending into the first compartment 21 and therethrough. That is, each hole 27 is connected to and adapted to communicate with the first compartment 21. Each hole 27 is of a circular cross section. Also, each hole 27 extends longitudinally along an axis "R3". The axis "R3" is perpendicular to the axis "R1". Additionally, the axis "R3" is perpendicular to the axis "R2".

The nozzle device 30 is disposed within the first compartment 21 of the housing 20. Furthermore, the nozzle device 30 includes a spacer 31 and a valve head actuator 32. The spacer 31 is hollow as it includes an orifice 311 extending therethrough. The orifice 311 defines a first orifice section and a second orifice section. The first orifice section extends from a first end to a second end, and the first end is defined at one of two terminal ends of the spacer 31. In addition, the second end is connected to the second orifice section. The second orifice section extends from a first end to a second end, and the first end is coincident with the second end of the first orifice section. In addition, the second end is defined at the other of the two terminal ends of the spacer 31. Additionally, the first orifice section has a smaller diametrical cross section than the second orifice section. The valve head actuator 32 is abutted against the spacer 31. Specifically, the spacer 31 is abutted against a first actuator member 321 of the valve head actuator 32. Additionally, the valve head actuator 32 includes a second actuator member 322 disposed behind and engaged with the first actuator member 321.

The urging mechanism 40 includes a cam 41, an axle 42, and a pivoting member 43. The cam 41 is disposed in the first compartment 21 of the housing 20, and includes an aperture 411 defined therein. The aperture 411 is of a non-circular cross section and includes a peripheral edge 411 that has a non-circular cross section. Furthermore, the valve head actuator 32 is abutted against the cam 41. Specifically, the second actuator member 322 of the valve head actuator 32 is abutted against the cam 41. The axle 42 is of a non-circular cross section that conforms to the cross section of the aperture 411*a* and includes a peripheral edge 42*a* that has non-circular cross section. Furthermore, the axle 42 is inserted through one of the two holes 27, into the aperture 411 of the cam 41, and through the other of the two holes 27, and includes two terminal ends exposed outside the housing 20. That is, one terminal end extends outside one of the two holes 27 while the other terminal end extends outside the other of the two holes 27, respectively. Additionally, because each hole 27 and the aperture 411 of the cam 41 have said configuration, the axle 42 is rotatable about the axis "R3" with respect to the housing 20, and the cam 41 engaged therewith is prevented from pivoting relatively about it. The pivoting member 43 is disposed outside the housing 20, is engaged with the axle 42, and includes an aesthetic and streamlined configuration that includes a user-interface portion 431 defining a first structural section 4311, two second structural sections 4312, two third structural sections 4313, and two connecting portions 432. The first structural section 4311 extends from a first end to a second end. One of the two third structural sections 4313 extends from the first end of the first structural section 4311, while the other of the two third structural sections 4313 extends from the second end of the first structural section 4311, respectively. Also, one of the two second structural sections 4312 extends from one third structural section 4313, and the other of the two second structural sections 4312 extends from the other third structural section 4313, respectively. In addition, the first, second and third structural sections 4311, 4312, and 4313 have the same cross-sectional shape and size. Furthermore, each second structural section 4312 extends from a first end to a second end in a straight line and is parallel to the other in a spaced relationship. Additionally, each third structural section 4313 extends from a first end connecting the first structural section 4311 to a second end connecting the first end of one second structural section 4312, and is parallel to the other in a spaced relationship. In addition, each third structural section 4313 is slanted with respect to the related second structural section 4312. The two connecting portions 432 extend from the user-interface portion 431. Specifically, the two connecting portions 432 extend from the second ends of the two second structural sections 4312, respectively. Accordingly, upon engagement of the pivoting member 43 with the axle 42, the two connecting portions 432 engage with the two terminal ends of the axle 42, respectively. In addition, each connecting portion 432 includes an aperture 4321 defined therein that one terminal end of the axle 42 is engaged in, and the aperture 4321 is of a non-circular cross section that conforms to the cross section of the axle 42. Each connecting portion 432 includes a peripheral edge 4321*a* that has a non-circular cross section. Consequently, the pivoting member 43 is prevented from pivoting relatively about the axle 42. Accordingly, the user would operate the user-interface portion 431 of the pivoting member 43 to pivot the axle 42.

Furthermore, the cam 41 includes first and second outer peripheral walls spaced from a center of the aperture 411 by a perpendicular distance "D1" and "D2", respectively, for abutting against the second actuator member 322 of the valve head actuator 32. The perpendicular distance "D2" is greater than the perpendicular distance "D1". That is, the spacer 31 and the valve head actuator 32 are urged towards the first end of the first compartment 21, and the spacer 31 is depressed, when the cam 41 is changed from a situation that its first outer peripheral wall is abutted against the second actuator member 322 of the valve head actuator 32 to a situation that its second outer peripheral wall is abutted against the second actuator member 322 of the valve head actuator 32. Additionally, the user-interface portion 431 of the pivoting member 43 is disposed close to the housing 20 when the first outer peripheral wall of the cam 41 is abutted against the second actuator member 322 of the valve head actuator 32, and is disposed away from the housing 20 when the second outer peripheral wall of the cam 41 is abutted against the second actuator member 322 of the valve head actuator 32, respectively. In this preferred embodiment, the pivoting member 43 is adapted to be ergonomically pivoted away from a position disposed close to the housing 20, because the third structural sections 4313 of the user-interface portion 431 are slanted away from the housing 20 so that the first structural section 4311 of the user-interface portion 431 is not too close to the housing 20 to allow the user to operate. In the preferred embodiment, the first and second outer peripheral walls of the cam 41 are substantially perpendicular to each other. Thereby, the pivoting member 43 is pivoted substantially through a 90 degree angle to cause a change from the situation that the first outer peripheral wall of the cam 41 is abutted against the second actuator member 322 of the valve head actuator 32 to the situation that the second outer peripheral wall of the cam 41 is abutted against the second actuator member 322 of the valve head actuator 32.

The end cap 50 is engaged with the housing 20 to prevent the nozzle assembly 30 from disengagement from the opening port 24 of the first compartment 21 of the housing 20. The end cap 50 extends from a first end to a second end, and includes an enclosing portion 51, an engaging portion 52, and an orifice 53. The enclosing portion 51 extends from a first end defined at the first end of the end cap 50 to a second end. The engaging portion 52 extends from a first end defined at the second end of the enclosing portion 51 to a second end. The orifice 53 extends from the first end to the second end of the end cap 50 and through the enclosing portion 51 as well as the engaging portion 52. Accordingly, upon engagement of the end cap 50 with the housing, the engaging portion 52 engages with a peripheral wall of the first compartment 21 of the housing 20. In the preferred embodiment, the end cap 50 is in thread engagement with the housing 20. Additionally, the enclosing portion 51 is disposed outside the housing 20 when the end cap 50 is engaged with the housing 20.

Figure 6:
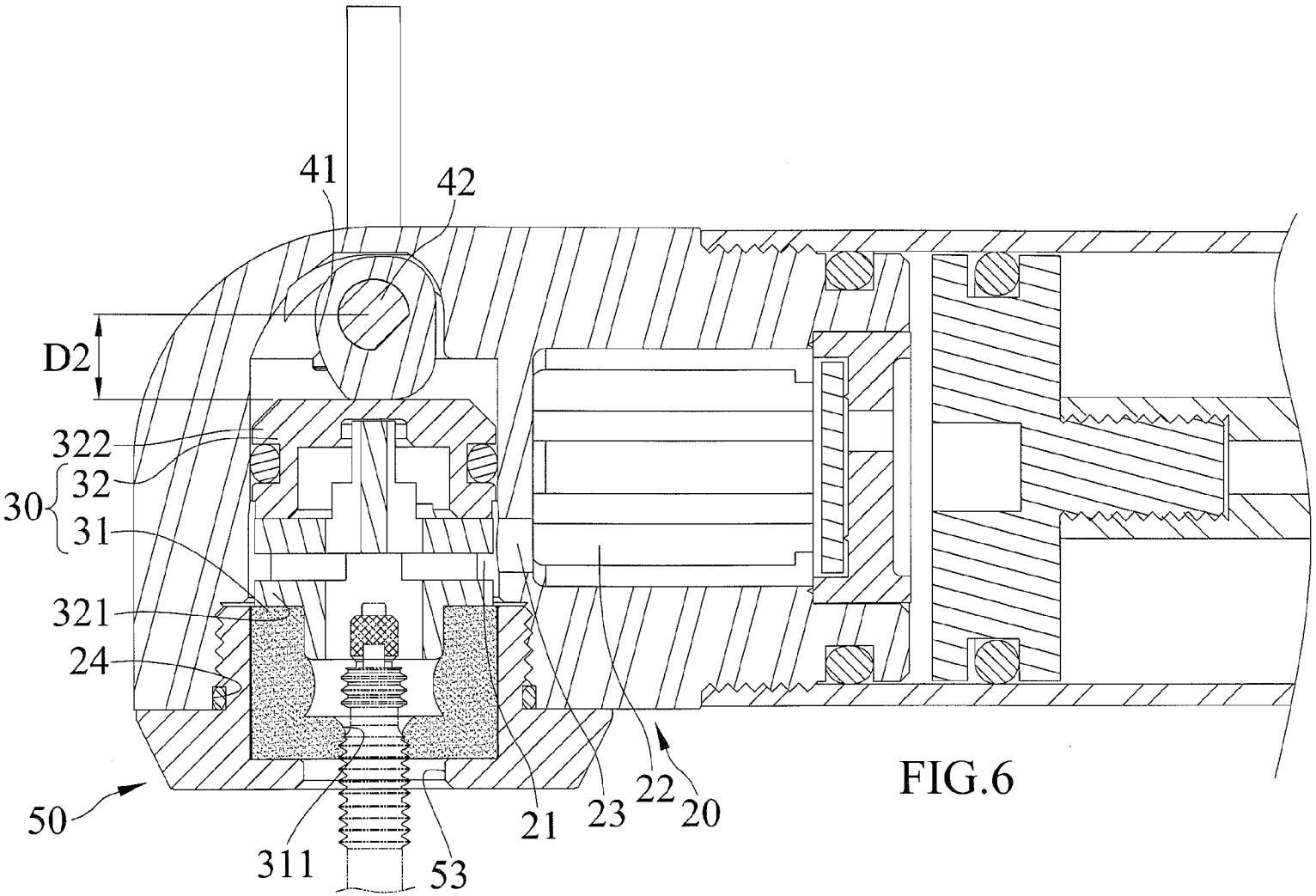
FIG. 6 is an extended cross-sectional view of FIG. 5 and shows the French valve in engagement with the head in a manner that the French valve can not disengage from the head, with the pivoting member in a second operation position.
Figure 7:
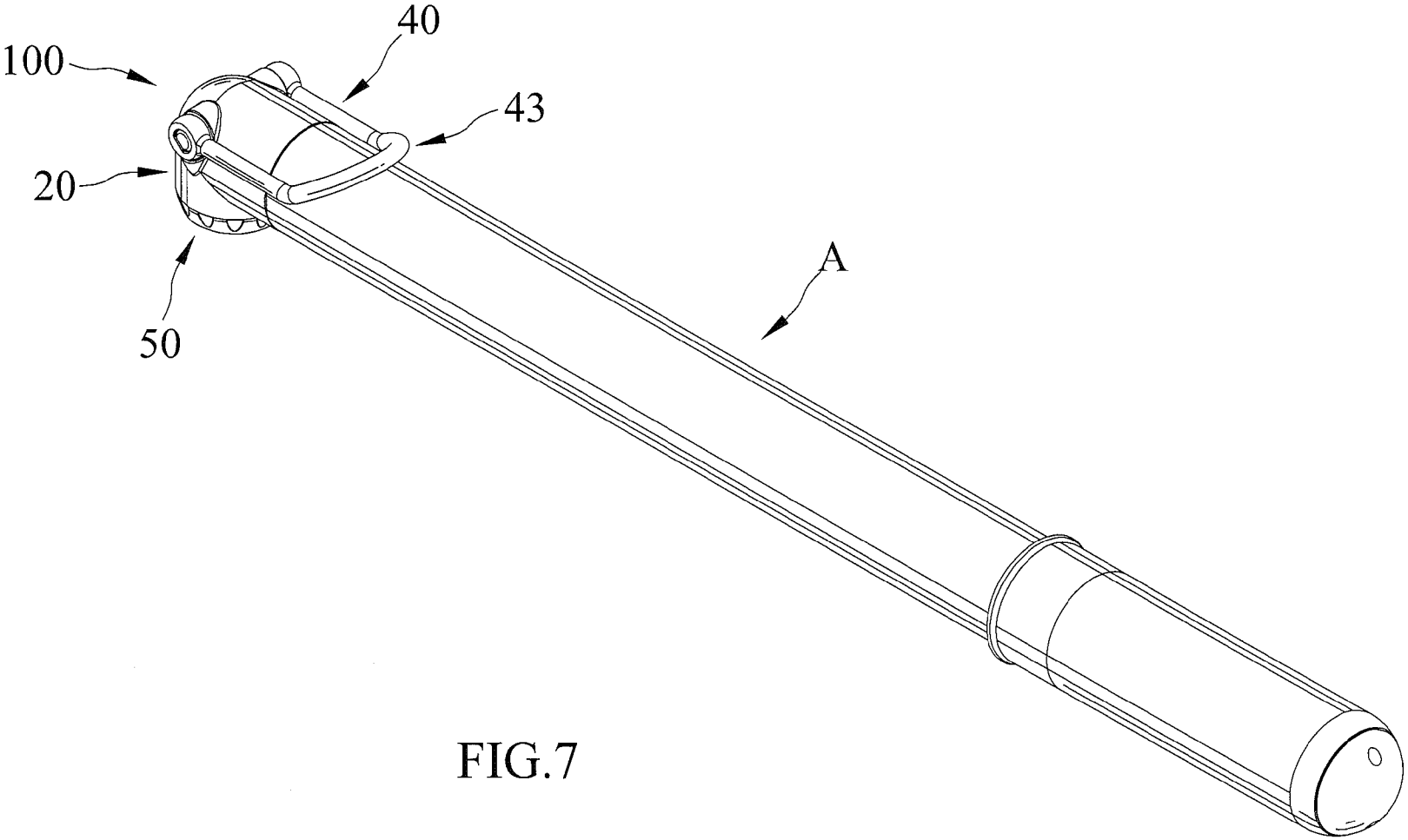
FIG. 7 is a perspective view showing an air pump including a head embodying the first embodiment of the present invention.
Figure 8:
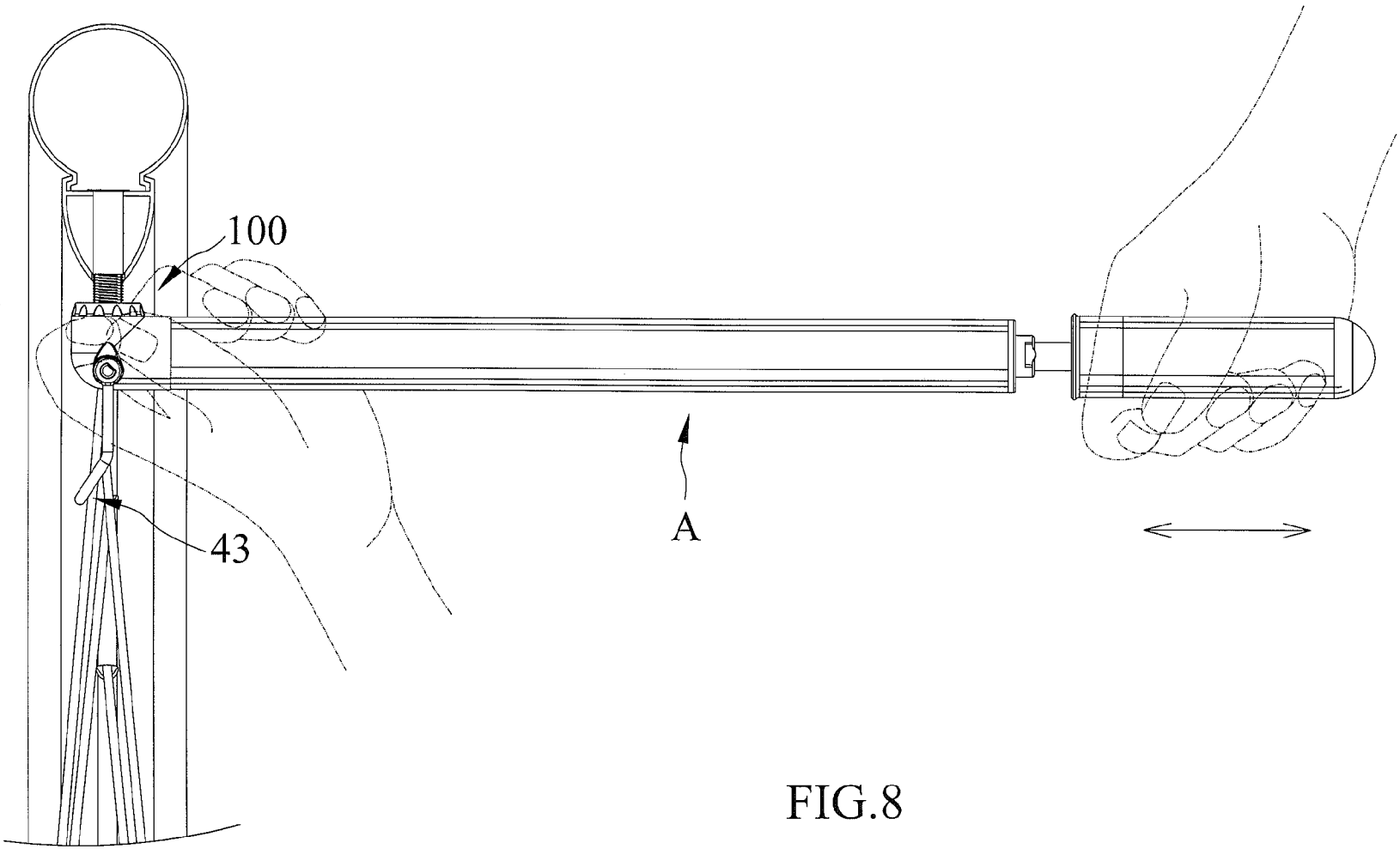
FIG. 8 shows the operation of the air pump shown in FIG. 7 to inflate a tire, with a valve of the tire in engagement with the head of the air pump.

Referring to FIGS. 7 and 8, the head 100 is utilized in connection with a mini air pump "A". The head 100 is joined to a cylinder of the air pump "A". Specifically, the second distal end 202 of the housing 20 of the head 100 is fixed to an end of the cylinder. Referring back to any of FIGS. 4-6, and 9-10, the cylinder has a pumping mechanism disposed therein that is utilized to pump air into the head 100 and moves reciprocally during the operation thereof.

Figure 4:
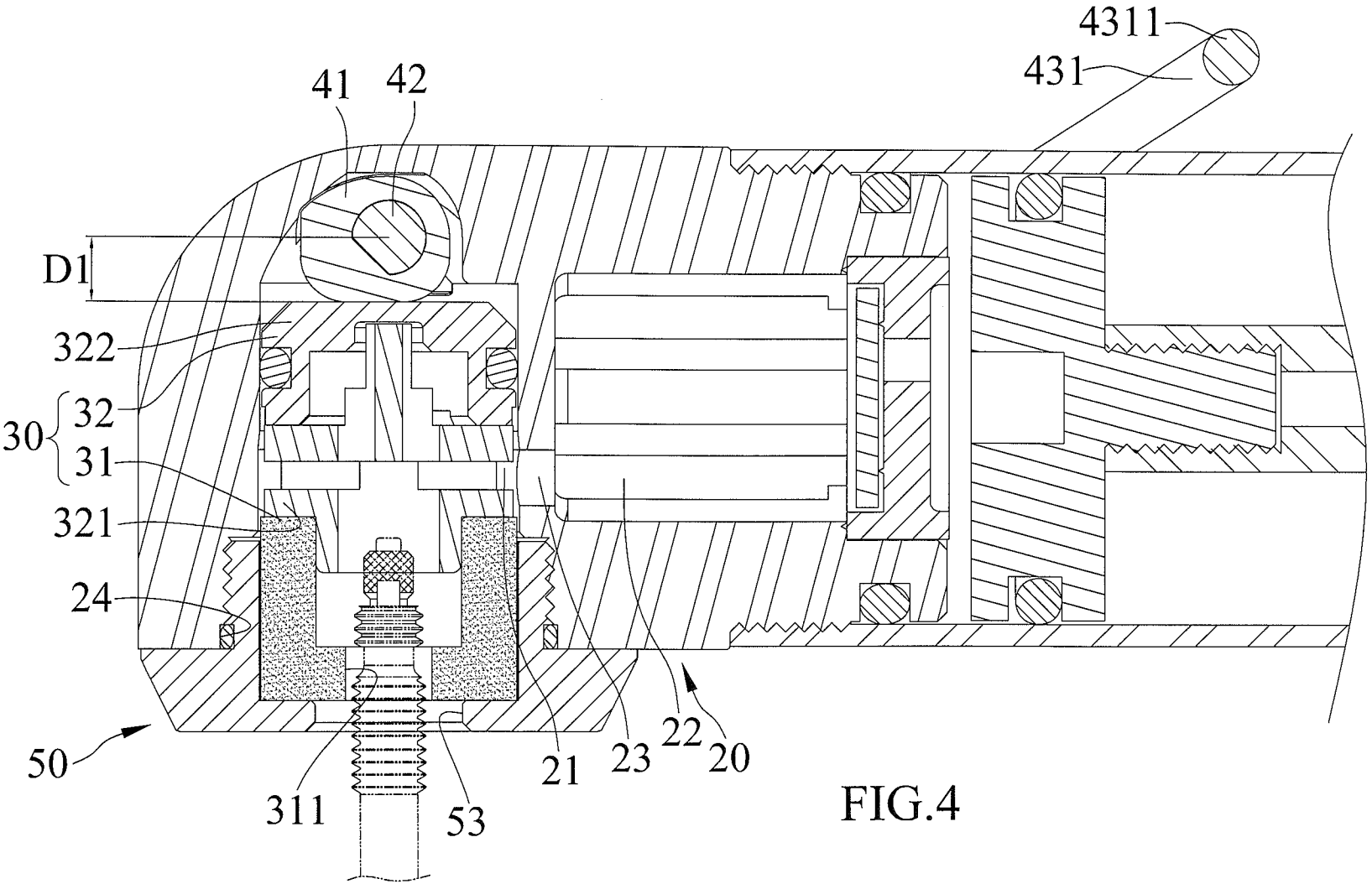
FIG. 4 is a cross-sectional view taken along line 4-4 of FIG. 1 and shows a pivoting member of the head in a first operation position and a French valve inserted in the head, with the French valve shown in phantom.
Figure 5:
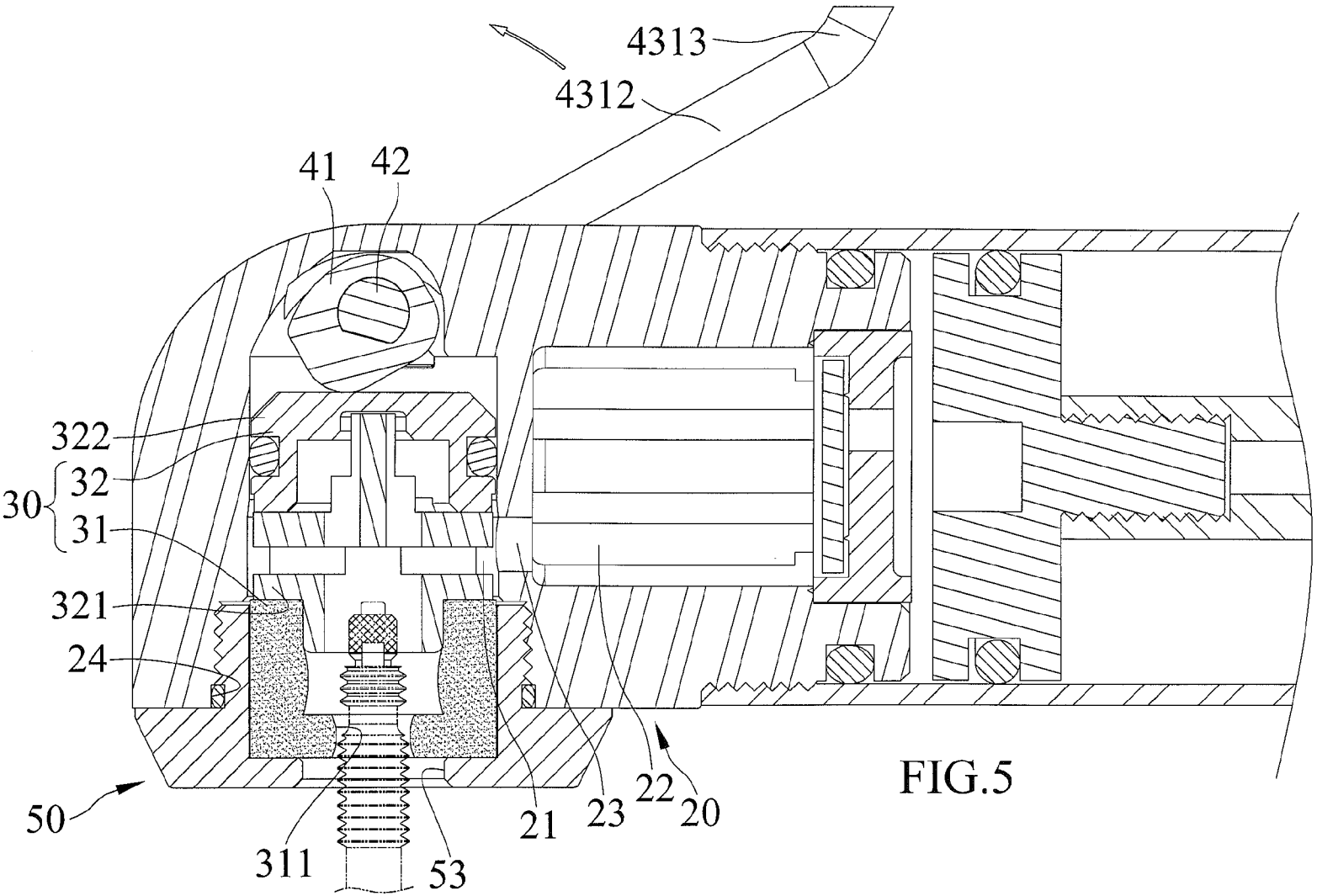
FIG. 5 is an extended cross-sectional view of FIG. 4 and shows the operation of the pivoting member.
Figure 9:
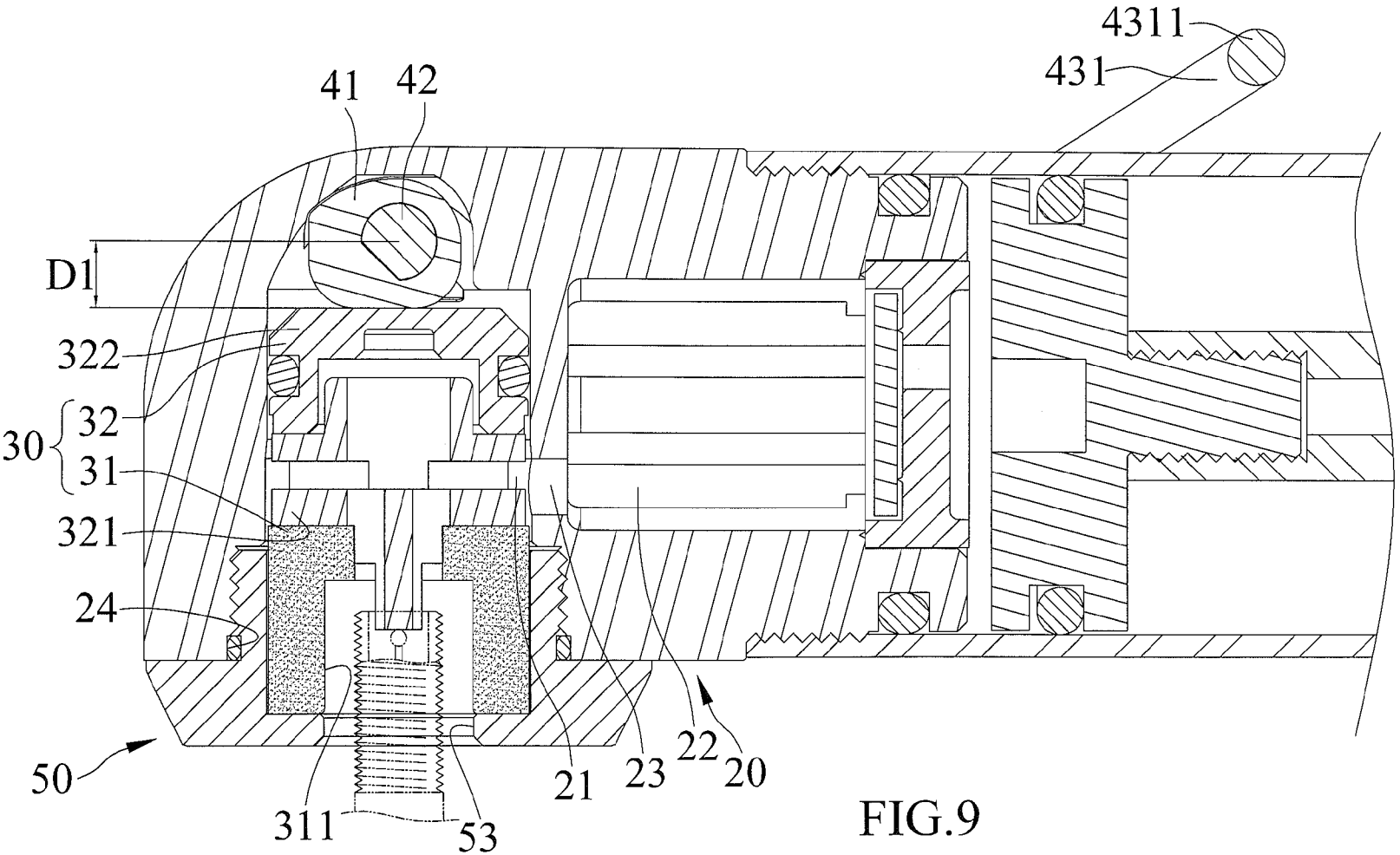
FIG. 9 shows an American valve inserted in the head embodying the first embodiment of the present invention, with the American valve shown in phantom.
Figure 10:
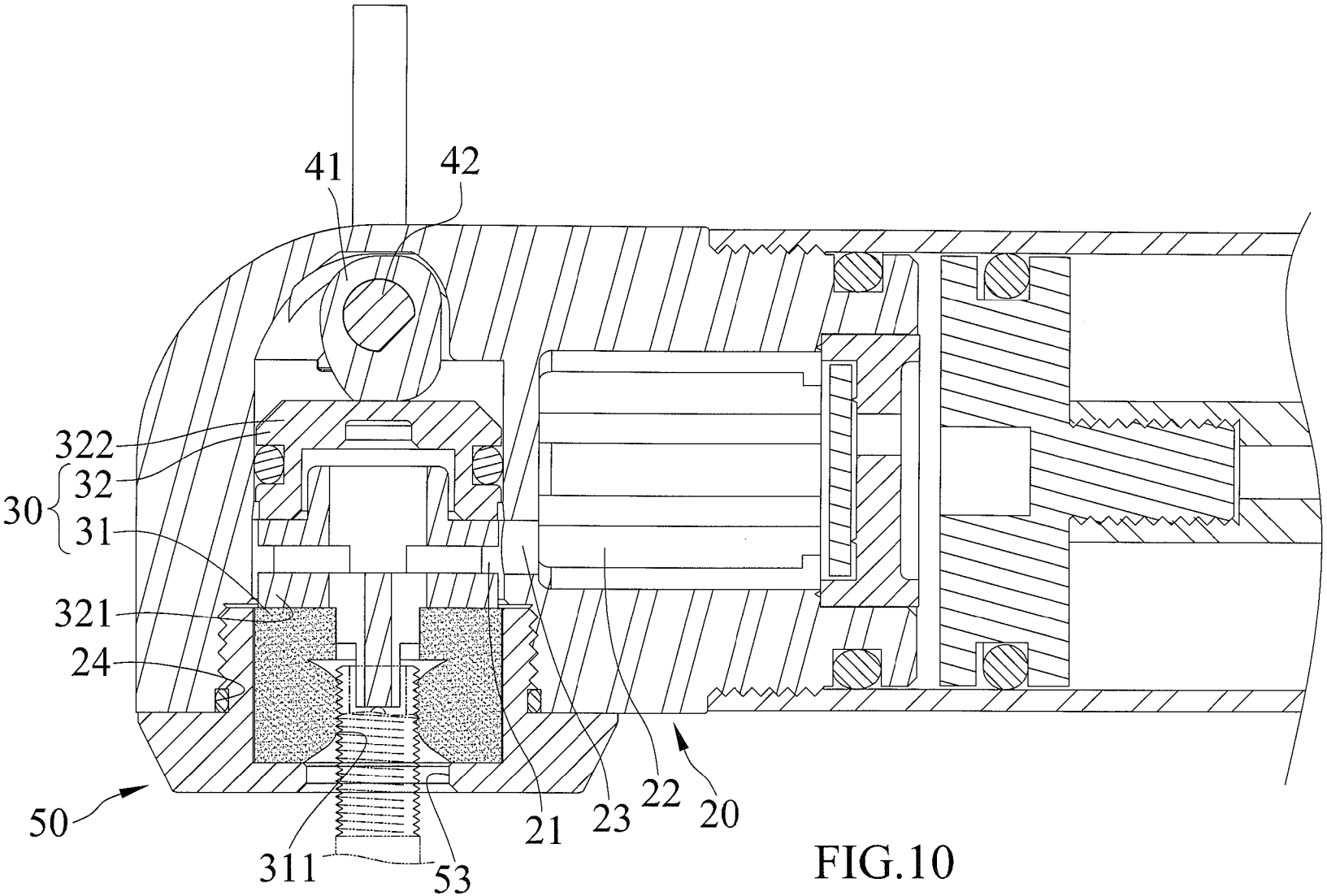
FIG. 10 is an extended cross-sectional view of FIG. 9 and shows the American valve in engagement with the head in a manner that the American valve can not disengage from the head, with the pivoting member of the head in a second operation position.

Furthermore, FIGS. 4 through 6 show that a French valve is engagable with the head 100, and FIGS. 9 and 10 show that an American valve is engagable with the head 100, respectively. In the former case, first and second actuating ends defined on two respective terminal ends of the first actuator member 321 are abutted against the spacer 31 and the second actuator member 322, respectively. On the contrary, the first and second actuating ends of the first actuator member 321 are abutted against the second actuator member 322 and the spacer 31, respectively, by changing the orientation of the spacer 31. Also, the spacer 31 is orientated differently for the two cases. In addition, the pivoting member 43 is pivoted from a position that is close to the housing 20 and that the first outer peripheral wall of the cam 41 is abutted against the second actuator member 322 of the valve head actuator 32 to a position that is away from the housing 20 and that the second outer peripheral wall of the cam 41 is abutted against the second actuator member 322 of the actuator 32 for engaging either the French valve or the American valve.

Figure 11:
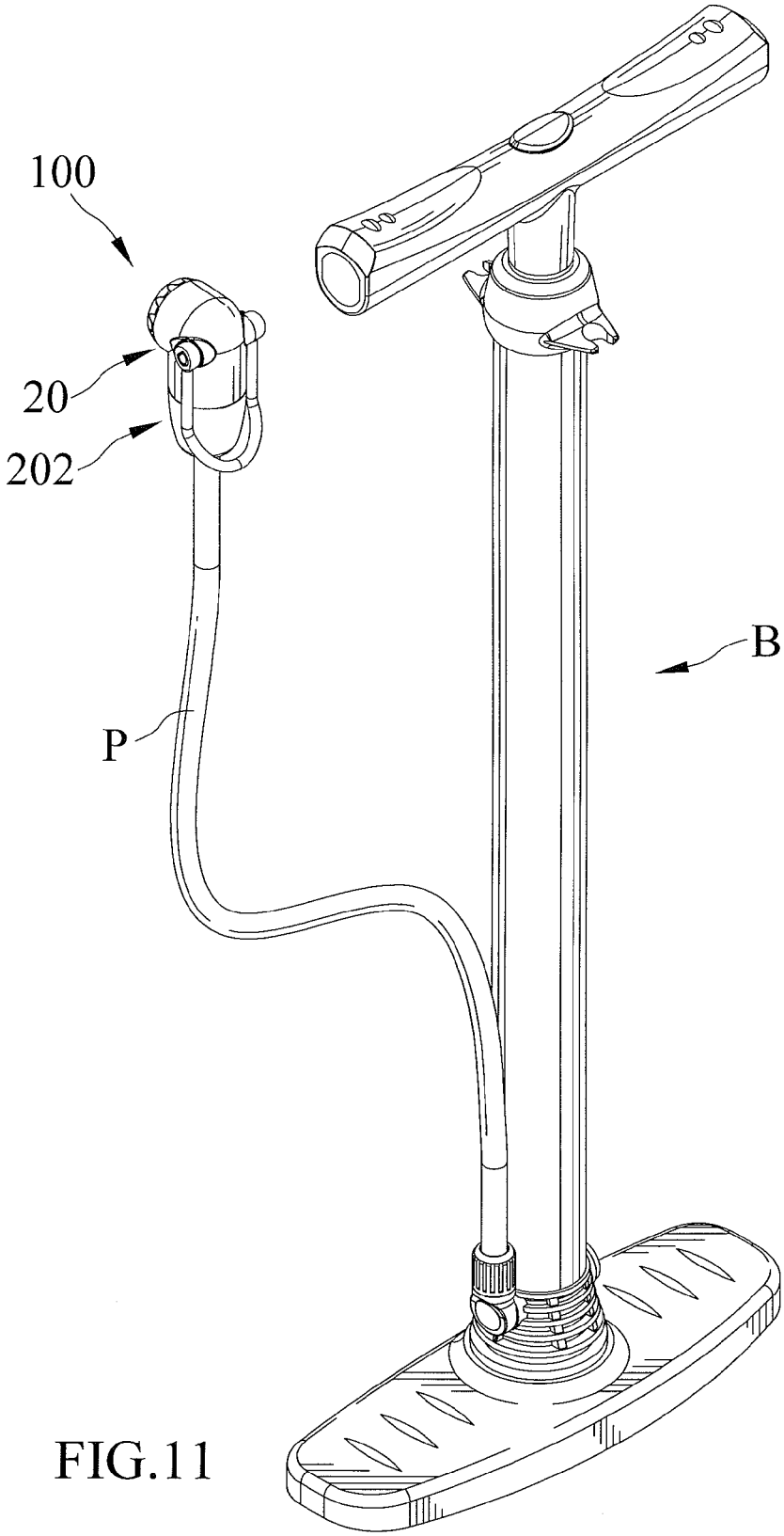
FIG. 11 is a perspective view of a head for an air pump in accordance with a second embodiment of the present invention.

Referring to FIG. 11, the head 100 is utilized in connection with a floor pump "B". The head 100 is joined to a flexible hose "P" extending from a cylinder of the floor pump "B". Specifically, the second distal end 202 of the housing 20 of the head 100 is fixed to an end of the hose "P". The flexible hose "P" is disposed outside the cylinder. Although not shown, the cylinder has a pumping mechanism disposed therein that is utilized to pump air into the hose "P" and the head 100 subsequently. The pumping mechanism moves reciprocally during the operation thereof. Although not shown, the head 100 is applicable in connection with a frame floor pump.

In view of the forgoing, there is no need for the user to continually push the head 100 to achieve an air-tight condition while carrying out an inflating operation as the urging mechanism 40 can continually urge the nozzle device 30 to engage with a valve of an object to be inflated in an air-tight manner. Additionally, the second end of the first compartment 21 is enclosed by the end wall 26. Consequently, the end wall 26 prevents dust particles from entering the first compartment 21 to damage the nozzle device 30. Furthermore, in order to allow the urging mechanism 40 to move the nozzle device 30, the cam 41, which is operably moved by the pivoting member 43 that is disposed outside the housing 20, is disposed inside the first compartment 21.

While the specific embodiments have been illustrated and described, numerous modifications come to mind without significantly departing from the spirit of invention, and the scope of invention is only limited by the scope of the accompanying claims.

What is claimed is:

1. A head for an air pump, comprising:

a housing extending from a first distal end to a second distal end and including a first compartment extending therein from a first end defined at the first distal end of the housing to a second end, with the second end of the first compartment enclosed by an end wall, and with the housing further including a hole extending therethrough and into the first compartment;

a nozzle device disposed within the first compartment of the housing;

an urging mechanism including a cam disposed in the first compartment of the housing and abutting against the nozzle device, an axle inserted into the housing through the hole and engaged with the cam, with the axle rotatable with respect to the housing, with the cam rotatable with the axle, and with the urging mechanism further including a pivoting member connected to the cam by engaging with a terminal end of the axle, with the pivoting member rotatable with the axle; and an end cap engaged with the first distal end of the housing;

wherein the pivoting member is operably pivotal about the axle to move the cam to urge the nozzle device in the first compartment for engaging with a valve of an object to be inflated; and wherein the end wall prevents external dust particles from damaging the nozzle device in the first compartment.

2. The head as claimed in claim 1 adapted to be utilized with an air pump, with the air pump including a cylinder and a pumping mechanism, with the pumping mechanism disposed inside the cylinder and operably moved in a reciprocal motion during operation of the air pump, with the second distal end of the head joined to the cylinder.

3. The head as claimed in claim 1 adapted to be utilized with an air pump, with the air pump including a hose, a cylinder and a pumping mechanism, with the hose being flexible and extending from the cylinder, with the pumping mechanism disposed inside the cylinder and operably moved in a reciprocal motion during the operation of the air pump, with the second distal end of the head joined to the hose.

4. The head as claimed in claim 1, wherein the nozzle device includes a spacer and a valve head actuator, with the spacer being depressible and including an orifice extending therethrough, with the valve head actuator releasably abutted against the spacer.

5. The head as claimed in claim 4, wherein the valve head actuator includes a first actuator member and a second actuator member disposed behind and releasably engaged with the first actuator member, with the first actuator member including first and second actuating ends defined on two terminal ends thereof respectively and abutted against the spacer, with the second actuator member abutted against the cam.

6. The head as claimed in claim 5 engagable with a French valve, with first and second actuating ends of the first actuator member abutted against the spacer and the second actuator member, respectively.

7. The head as claimed in claim 5 engagable with an American valve, with the first and second actuating ends of the first actuator member abutted against the second actuator member and the spacer, respectively.

8. The head as claimed in claim 4, wherein the orifice of the spacer defines a first orifice section and a second orifice section, with the first orifice section extending from a first end defined at one of two terminal ends of the spacer to a second end, with the second orifice section extending from a first end coincident with the second end of the first orifice section to a second end defined at the other of the two terminal ends of the spacer, with the first orifice section having a smaller diametrical cross section than the second orifice section.

9. The head as claimed in claim 1, wherein the hole of the housing includes two holes, wherein the axle includes two terminal ends extending outside the two holes respectively, wherein the pivoting member includes a user-interface portion and two connecting portions, wherein the user-interface portion defines a first structural section, two second structural sections, and two third structural sections, with the first, second and third structural sections cooperating to form a continuous shape, with each second structural section extending in a straight line and parallel to the other in a spaced relationship, with each third structural section extending in a straight line and parallel to the other in a spaced relationship, with the two connecting portions extending from the second structural sections of the user-interface portion and engaging with the terminal end of the axle to connect the pivoting member with the axle.

10. The head as claimed in claim 9, wherein the first, second, and third structural sections have a same cross-sectional shape and size.

11. The head as claimed in claim 9, wherein each third structural section is slanted with respect to each second structural section and away from the housing.

12. The head as claimed in claim 1, wherein the cam includes an aperture defined therein receiving the axle, with first and second outer peripheral walls of the cam spaced from a center of the aperture by first and second perpendicular distances, respectively, with the second perpendicular distance greater than the first perpendicular distance, with the spacer and the valve head actuator urged towards the first end of the first compartment when the cam is changed from a situation that the first outer peripheral wall is abutted against the valve head actuator to a situation that the second outer peripheral wall is abutted against the valve head actuator.

13. The head as claimed in claim 12, wherein the first and second outer peripheral walls of the cam are substantially perpendicular to each other.

14. The head as claimed in claim 1, wherein the end cap includes an enclosing portion, an engaging portion, and an orifice, with the orifice extending through the enclosing portion as well as the engaging portion, with the enclosing portion disposed outside the housing and the engaging portion engaging with a peripheral wall of the first compartment when the end cap is engaged with the housing.

* * * * *